US005113559A

United States Patent [19]

LaRoche et al.

[11] Patent Number: 5,113,559

[45] Date of Patent: May 19, 1992

[54] ROTARY DRUM WITH POINTS FOR A TEXTILE MACHINE, AN OPENER, A DESINTEGRATOR, A TEARER

[75] Inventors: Robert LaRoche; Andre Morel, both of Cours-la-Ville, France

[73] Assignee: Constructions Mechaniques F. LaRoche & Fils, Cours la Ville, France

[21] Appl. No.: 364,435

[22] PCT Filed: Sep. 1, 1988

[86] PCT No.: PCT/FR88/00432

§ 371 Date: Jul. 5, 1989

§ 102(e) Date: Jul. 5, 1989

[87] PCT Pub. No.: WO89/02000

PCT Pub. Date: Mar. 9, 1989

[30] Foreign Application Priority Data

Sep. 2, 1987 [FR] France ..... 87 12706

[51] Int. Cl.[5] ..... B02C 18/00; D01G 15/12

[52] U.S. Cl. ..... 29/121.1; 29/124; 19/112

[58] Field of Search ..... 29/116.1, 121.1, 121.3, 29/121.5, 121.6, 894.2, 124, 125; 19/85, 94, 97, 112

[56] References Cited

U.S. PATENT DOCUMENTS

| | | | |
|---|---|---|---|
| 243,171 | 6/1881 | Stone | 19/112 |
| 417,566 | 12/1889 | Knowles et al. | 19/112 |
| 1,529,826 | 3/1925 | Alexander | 19/97 |
| 1,719,730 | 7/1929 | Schoenfeld | 29/121.1 X |
| 2,193,528 | 3/1940 | Bock et al. | 19/97 |
| 2,261,452 | 11/1941 | Reed et al. | 19/97 |

FOREIGN PATENT DOCUMENTS

| | | | |
|---|---|---|---|
| 859253 | 10/1952 | Fed. Rep. of Germany | 29/121.3 |
| 2544291 | 4/1977 | Fed. Rep. of Germany . | |
| 2449144 | 6/1980 | France . | |
| 739311 | 9/1955 | United Kingdom . | |

*Primary Examiner*—Joseph M. Gorski
*Assistant Examiner*—Peter Dungba Vo
*Attorney, Agent, or Firm*—Basile and Hanlon

[57] ABSTRACT

The invention relates to the fixing of staves (10) provided with points (12) to the cylinder (1) of a textile machine drum. Inside the cylinder (1) bars (6) provided with threaded holes (8) are slid. The half-openings (14) of the bases (11) of the staves (10) are facing each other by pairs. The pieces (18) provide for the blocking. Application: time reduction of labor for the mounting and replacement of the staves, possibility of fitting long cylinders with small diameters without the need for the operator to pass his hand inside the cylinder.

7 Claims, 4 Drawing Sheets

ROTARY DRUM WITH POINTS FOR A TEXTILE MACHINE, AN OPENER, A DESINTEGRATOR, A TEARER

BACKGROUND OF THE INVENTION

1. Field of the Invention

The present invention relates to a rotary drum with points of a new type, the points being for use on textile machines, such as openers, tearers or disintegrators.

2. Description of the Relevant Art

It is known that such a textile machine includes one or many successive drums, upon which are passed textile materials. This is done for the purpose of opening virgin fibers, or for reproducing fibers by putting together scraps.

For treating these fibers and scraps, the known machines include one or more successive drums, as a function of the desired degree of refining. These drums are generally equipped with points or needles, with round or oblong section, mounted in supports of wood, metal or plastic material called "staves." Each stave includes therefore a plate more or less curved, on the exterior of which the points or teeth of the drum pass. These staves are mounted on the periphery of a cylinder or rotor: the entirety constitutes the drum.

The attaching of the staves on the cylinder of a drum of the known type is done in a conventional manner, such as with screws and nuts. To attach the staves in this manner, one engages each screw through the stave, then through a perforation situated opposite the cylinder, where it enters from the exterior toward the interior. The head of the screw takes support on the plate of the stave. The threaded shaft of the screw passes in this way to the interior of the cylinder, where one then puts in place a tightening nut. Consequently, one must provide openings of large enough dimensions, in the supporting end plates situated at two extremities of the cylinder, in order to permit the operator to pass his arm through these openings to reach the internal face of the cylinder, where each nut is put in place.

This structure of the drums of the known type is limited by the following inconveniences. Access to the internal face of the cylinder is difficult, because the diameter of the cylinder is smaller. On the other hand, the axial length of the cylinder is limited, by the length of the arm of the operator. In practice, the length of the drum cannot pass 1½ meters and its diameter must remain above ¾ meter. In addition, labor time is too large for changing or replacing the staves: the nuts must be introduced, put in place and tightened one by one in the interior of the cylinder.

By way of example, a tearing drum of a diameter of one meter and of a length of one meter requires generally 340 screws of attachment for the staves. These staves constitute parts of wear that it is necessary to change, for example, every 800 hours of operation. This frequency of change is yet augmented if the textile scraps for tearing are susceptible to containing foreign bodies which deteriorate the point of the drum.

To try to avoid these inconveniences, the holes of attachment pierced in the cylinder could be threaded: that would permit screwing the screws from the exterior in each machined threading in the thickness of the cylinder. In practice, such a solution is unusable, because on the one hand, that would require the face of the cylinder to have an exaggerated thickness, while on the other hand, the deterioration of a single thread would result in the destruction of the cylinder. It is not possible to take such a risk for operations of installing and removing staves, which are continually repeated operations on a given drum.

SUMMARY OF THE INVENTION

The object of the present invention is to avoid these inconveniences, in order to facilitate the mounting and the unmounting of staves on a textile machine drum, such as, for example, a disintegrator, an opener, a tearer, a gauge, a carding machine or the like. Further, the invention tries to accomplish this device on staves created of any material, such as wood, plastic material or metal. Finally, the invention tries to facilitate the changing of the staves, even on a drum of thin diameter and large axial length. For example, it allows, without difficulty, equipping a drum whose work width would be on the order of two meters, even if its diameter was not greater than 50 cm.

A drum according to the invention includes a perforated cylinder, on the periphery of which are distributed longitudinal staves, provided with points. The stave's base plate is traversed by openings, through which are passed, from the exterior toward the interior, the threaded shaft of a screw whose head stays at the exterior of the drum. Against the interior periphery of the cylinder are distributed longitudinal bars, each of which is pierced by many threaded holes, provided for receiving the screwing of the corresponding extremities of the screw which is engaged and controlled from the exterior.

Following another characteristic of the invention, each bar has approximately the same length as the cylinder of the drum, so that one can slide each bar to the interior of the drum from the extremities of the cylinder without ever having to put one's arm in the interior of the cylinder.

Following another characteristic of the invention, the supporting end plates at the extremities of the cylinder are not perforated: it is sufficient to provide, on the periphery of each of them, some small openings through each of which one slides one of the longitudinal bars. Following another characteristic of the invention, the threaded holes of a bar are aligned, parallel to the corresponding generator of the cylinder.

Following another characteristic of the invention, the exterior openings are cut on the bases of two adjacent staves, so that each screw head takes support at one time on two adjacent bases.

Following another characteristic of the invention, each screw assembly is completed by a piece or collar. The screw traverses the central part of the piece. This piece then defines a widened flange on both sides of the head of the screw.

According to another characteristic of the invention, the flange of each piece is circular.

Following another characteristic of the invention, the widened flange of each piece is narrower in part than the circular flange due to two flat parallel spaced surfaces on the flange, situated on both sides of the head of the screw. In this case, each opening cut on two adjacent bases has an approximately rectangular form, of which the length is greater or equal to the larger diameter of the flange of a piece, then its width is equal to the near clearance, at the distance separating the two parallel surfaces of the flange. This arrangement is particularly advantageous, because, in order to disengage a screw and its flange, one has only to release the screw, and make the piece turn 90 degrees, in one direction or in the other: it is not necessary to completely unscrew the screws and to extract them, in order to be able to unmount the staves.

BRIEF DESCRIPTION OF THE DRAWINGS

Other objects and features of the invention will be apparent by reference to the following specification and to the drawings, in which.

DESCRIPTION OF THE PREFERRED EMBODIMENT

Figure 1:
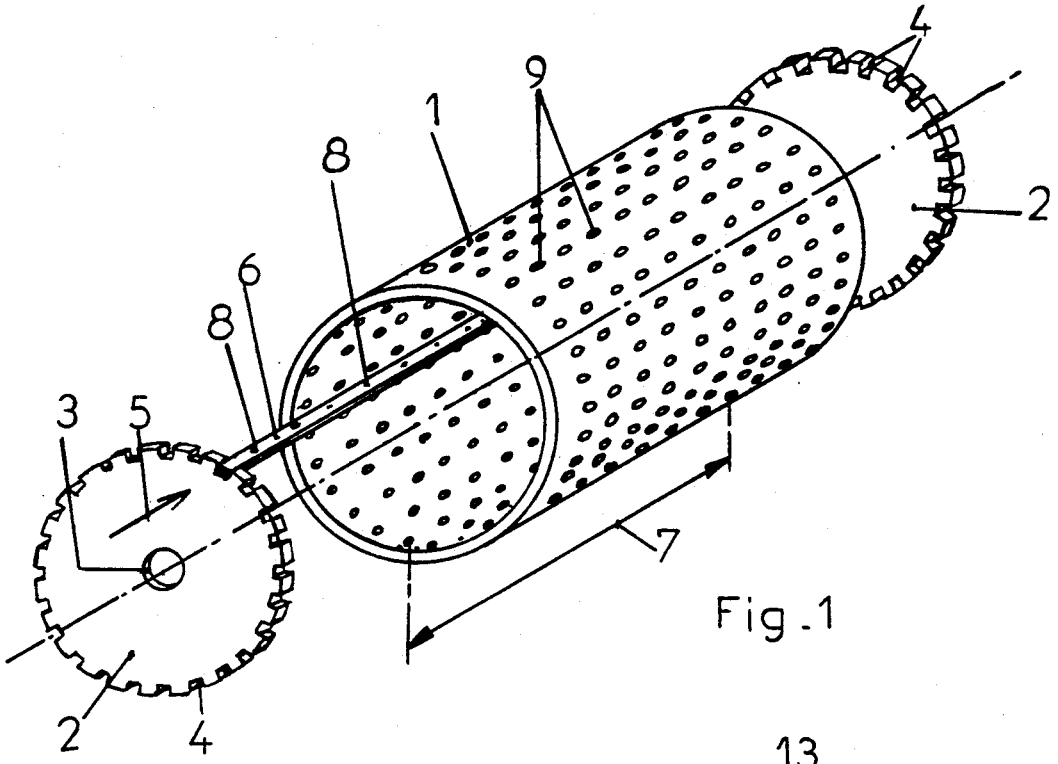
FIG. 1 is an exploded perspective view of the cylinder, the supporting end plates and one of the threaded bars of a drum according to the invention.

FIG. 1 shows a cylinder 1, provided at each of its two extremities with a transversal end plate 2. Each end plate 2 according to the invention is pierced with a central hole 3, and with a series of peripheral notches 4.

Through each notch 4, one slides to the interior of the cylinder 1 (in the direction of arrow 5), a longitudinal bar 6, whose length is approximately equal to the axial length 7 of cylinder 1.

The length of each bar 6 is distributed with threaded holes 8, which are aligned.

Once the bar 6 is in place in the interior of cylinder 1, each threaded hole 8 is aligned with a smooth hole 9, pierced in the wall of cylinder 1.

Against the exterior face of the cylinder 1, one applies staves 10. Each stave 10 comprises a base plate 11, equipped with a series of points 12 which are mounted on it. Each base 11 is longitudinally disposed on the exterior of the cylinder 1, and base 11 comprises, cut the length of its two longitudinal sides 13.

Figure 2:
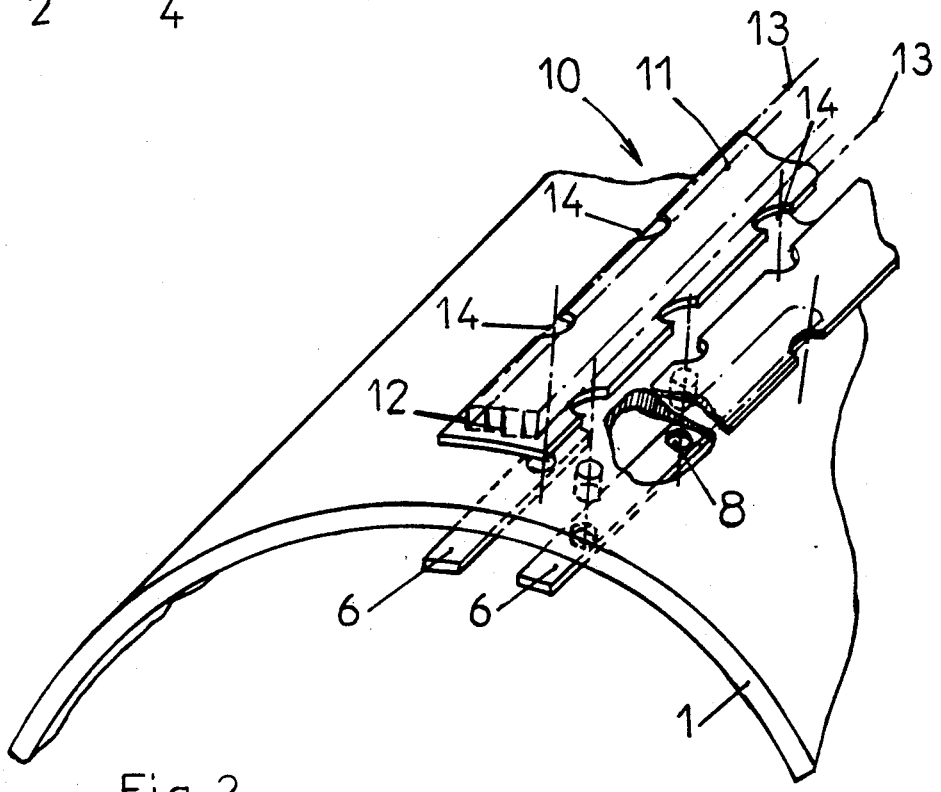
FIG. 2 is a partially cut-away detailed view, showing in perspective the attachment of two adjacent staves.
Figure 3:
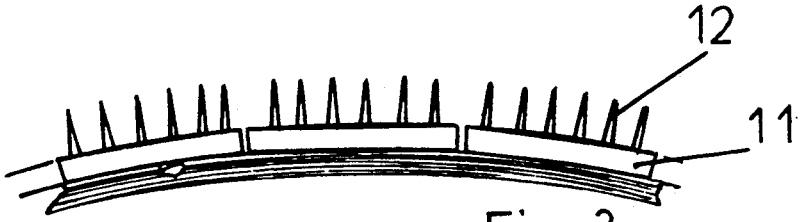
FIG. 3 is an end view showing staves whose bases are disposed longitudinally side by side on the face of the cylinder.
Figure 4:
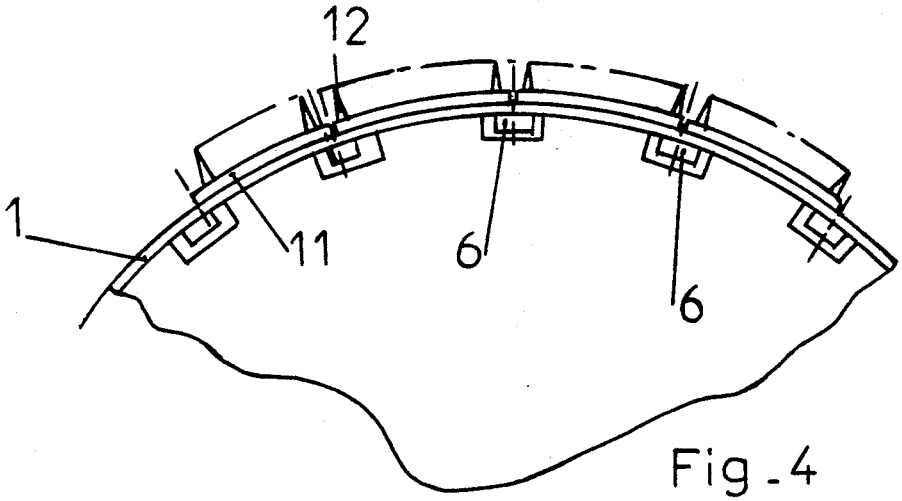
FIG. 4 is the view of FIG. 3 after assembly of the supporting end plates, and put in place with the threaded bars.

When the staves 10 are placed side by side on cylinder 1 (FIG. 6), each half notch 14 is located coaxially placed above a hole 9 in cylinder 1, and, consequently, above a threaded hole 8 in a bar 6. In this way, when the half notches 14 have the contour of a half circle (in the case of FIGS. 2, 5 and 6), two half notches 14 situated face to face (FIG. 5) define a smooth circular hole.

In this way, a screw 15 is engaged in the stack of openings described above, in order that the screw head 16 comes to pinch the sides 13 opposite the adjacent staves 10. Moreover, the threaded shaft 17 engages itself in the corresponding threaded hole 8 in the bar 6, where it is sufficient to block shaft 17 in order to terminate the mounting.

Figure 5:
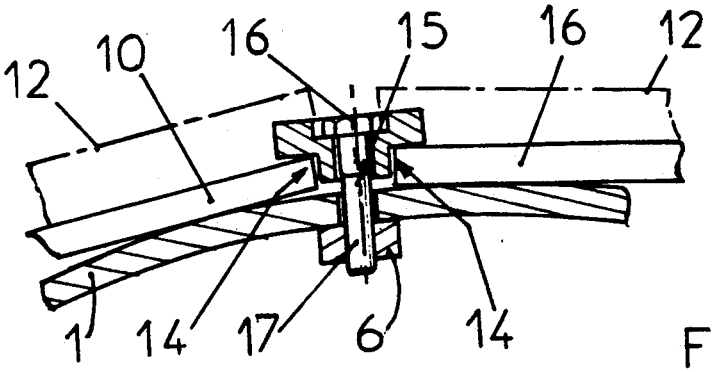
FIG. 5 is a partial detailed view showing one screw cooperating with a piece.
Figure 6:
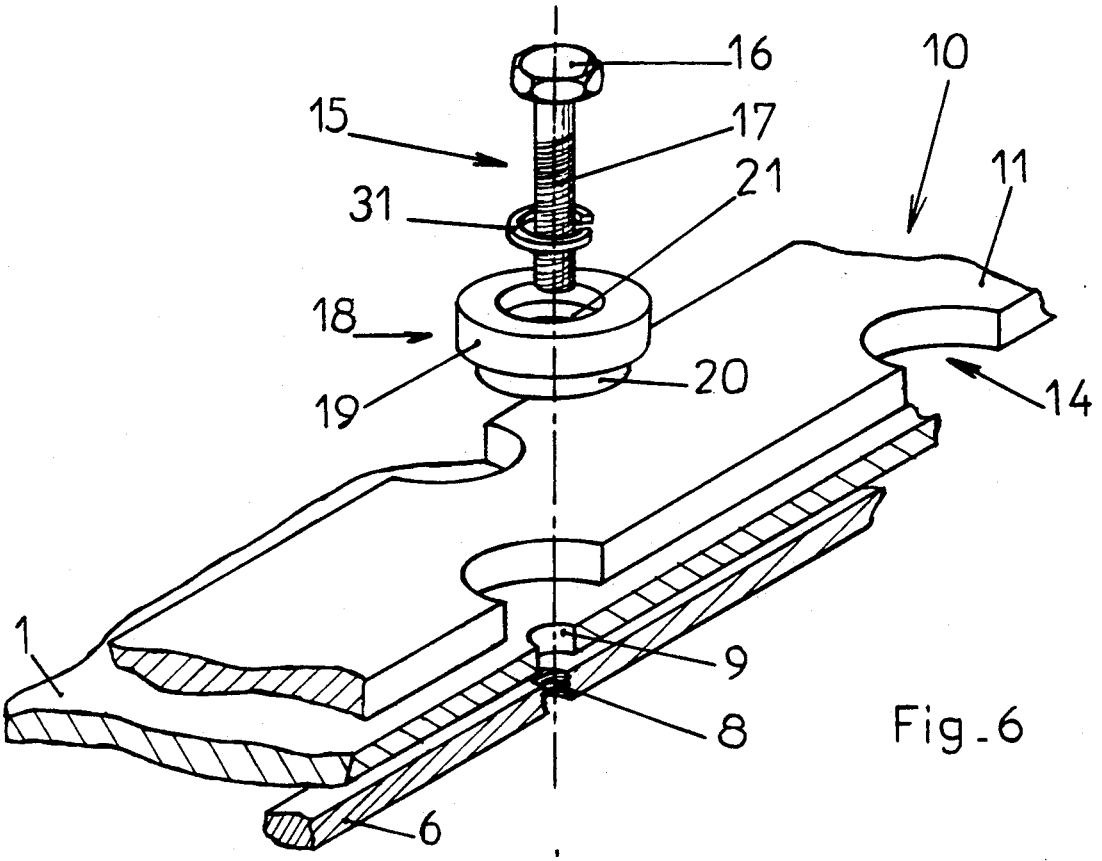
FIG. 6 is an exploded view showing each screw equipped with a fixed circular piece.

In the example illustrated in FIGS. 5 and 6, one completes the assembly by placing under head 16, and around it, a circular piece or collar 18. This piece 18 comprises a widened circular flange 19, which is mounted on central stem 20. The height of stem 20 corresponds approximately to the width of base 11 of each stave 10 thereby assuring the pinching of sides 13. The circular half notches 14 have a diameter corresponding approximately to the exterior diameter of stem 20 which is engaged in half notches 14. Finally, each piece 18 is equipped with, in its center, a bore 21 which threaded shaft 17 goes through.

Figure 7:
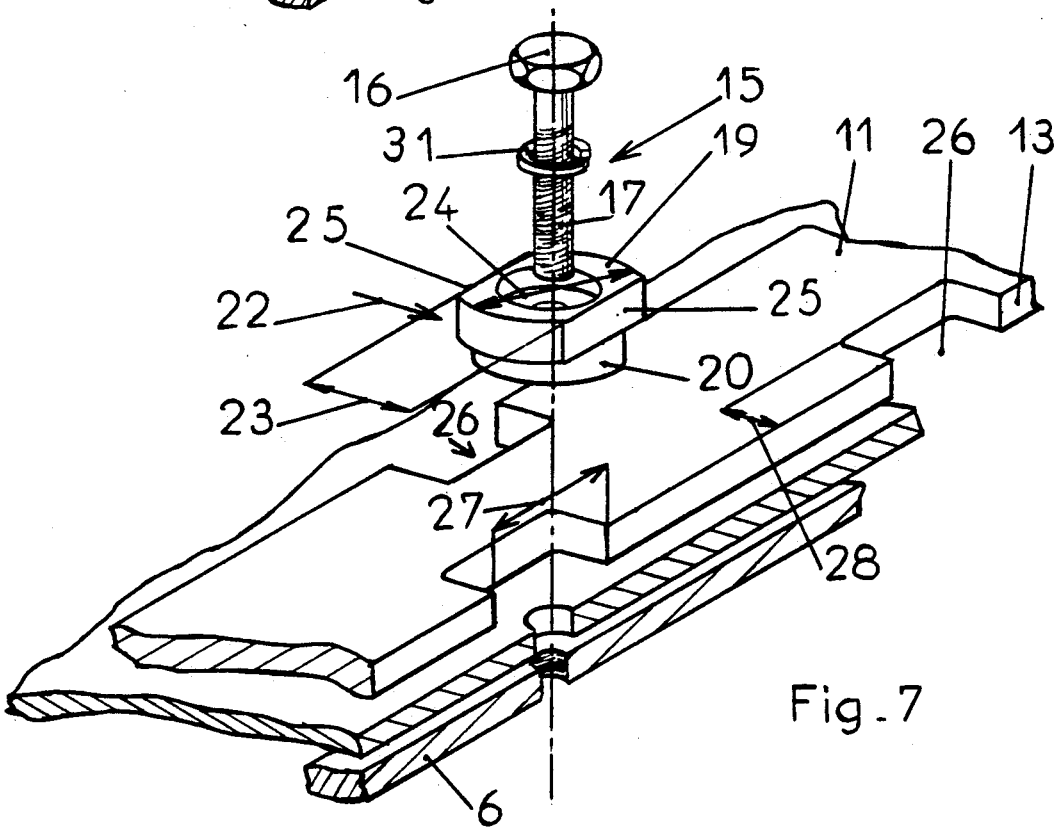
FIG. 7 is an exploded view of a piece turnable at the flat, parallel surfaces of the flange.
Figure 8:
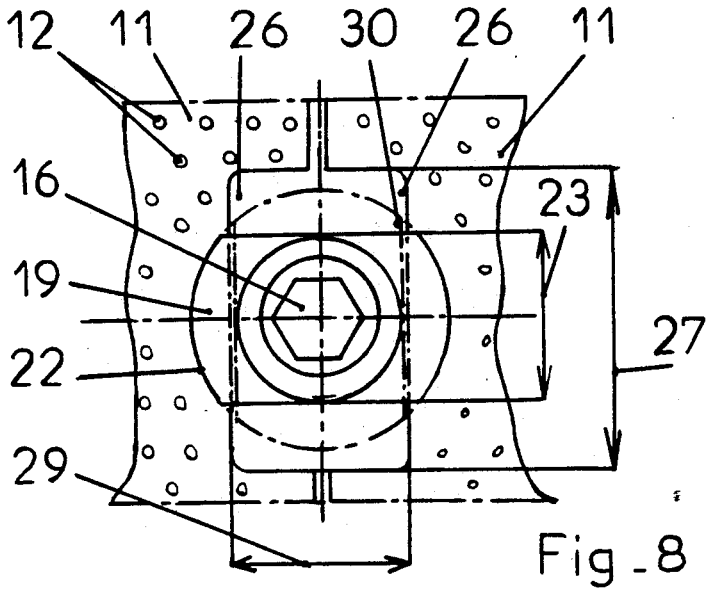
FIG. 8 is a plan view illustrating the rotational working of the piece of FIG. 7 at the parallel surfaces.
Figure 9:
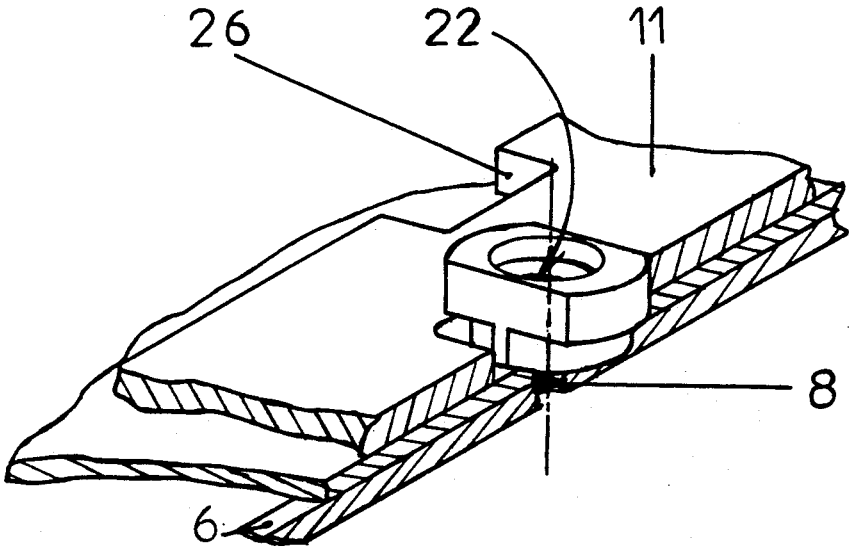
FIG. 9 shows the piece of FIG. 7 after being put in place.

In the example illustrated in FIGS. 7, 8 and 9, each screw 15 cooperates with piece 22. As with piece 18, this has a widened flange 19 mounted on a stem 20, but the flange 19 is locally rendered more narrow (width 23, smaller than diameter 24) by the presence of two flat sections 25 on flange 19. In this case, one cuts some half openings 26 the length of the longitudinal side 13 of each base 11. Each half opening 26 has a rectangular contour. The length 27 of each half opening 26 is equal to or greater than diameter 24. On the contrary, the width 28 of each half opening 26 is approximately equal to half of the width 23.

In this way, at the assembly, two adjacent bases 11 (FIG. 8) have their half openings 26 facing each other two by two. Each pair of half openings 26 defines therefore a rectangular opening of length 27 and of width 29, greater than or equal to distance 23. Consequently, if the two flat portions 25 are oriented parallel to length 27 (shown by dashed line 30 in FIG. 8), each stave can be extracted without being obstructed by flange 19 (see FIG. 7). On the contrary, if bases 11 are in place and one wishes to block the staves on cylinder 1, it is sufficient to make each piece 22 turn 90 degrees (as illustrated in full line by reference numeral 22 in FIG. 8): the flange 19 sticks out then from the bases 11 that flange 19 pinches, and flange 19 stays in place after simple tightening of screw 15. In this case, the exchange of one or many staves 10 can be accomplished, without even it being necessary to completely extract screws 15. It is sufficient to release them and make each of the pieces 22 turn 90 degrees.

The usage of circular pieces 18 or pieces 22 with flat portions 25 presents in all cases the advantage of counter-sinking screw head 16 in the wall of piece 18 or 22. In this way, the following problems can be avoided. Fibers will not be caught around the head 16 since it is no longer projecting, as in classical attachments. There will be no mechanical damage of the head 16 due to shocks, etc., and thus, no head damage to prevent good utilization of tools for tightening and untightening.

A further advantage is obtained by the placement of a lock washer 31 under screw head 16, with washer 31 also being counter-sunk in the wall of piece 18 or 22.

It is to be understood that the foregoing specification is merely exemplary and not limitative, and that the true scope of the invention is that defined in the following claims.

We claim:

1. A drum for a textile machine, comprising:

a cylinder having an interior and an exterior periphery;

a plurality of apertures formed in the cylinder;

a plurality of longitudinal staves, each having a base plate and a plurality of points, the staves being distributed on the exterior periphery of the cylinder;

a plurality of apertures formed in the base plate;

a plurality of longitudinal bars distributed against the interior periphery of the cylinder;

a plurality of threaded apertures formed in the bars;

means, removably receivable through the base plate apertures, the cylinder apertures and the threaded bar apertures, respectively, for securing the staves to the cylinder, wherein the securing means comprises a plurality of screws, each having a head and threaded shaft;

a plurality of collars, each having a central bore for receiving one of the plurality of screws, the collar further having an enlarged flange for surrounding the head of the screw;

two, parallel spaced flat portions formed on the flange, the width between the flat portions having a width narrower than the diameter of the flange; and a plurality of exterior half openings cut on two adjacent base plates, the openings having an approximately rectangular form, the length of the half openings being greater than or equal to the diameter of the flange, and the width of the half openings being equal to the width of the flange between the two flat portions.

2. The drum as defined in claim 1, wherein each bar has approximately the same length as the cylinder.

3. The drum as defined in claim 1 wherein the threaded apertures of the bars are aligned parallel to the corresponding apertures in the cylinder.

4. The drum as defined in claim 1 wherein each head of each screw is supported on two adjacent base plates.

5. The drum as defined in claim 1, wherein the flange of each collar is circular.

6. The drum as defined in claim 1, wherein the head of the screw is counter-sunk in the collar.

7. The drum as defined in claim 1 further comprising: an end plate disposed on each end of the cylinder; and a plurality of apertures formed in the periphery of the end plates, for receiving the longitudinal bars.

* * * * *